US006105683A

United States Patent [19]

Thiessen

[11] Patent Number: 6,105,683

[45] Date of Patent: Aug. 22, 2000

[54] POST PICKER

[76] Inventor: Terry Thiessen, Box 2351, Strathmore, Alberta, Canada, T1P 1K3

[21] Appl. No.: 09/232,918

[22] Filed: Jan. 19, 1999

[51] Int. Cl.[7] ..... E02D 7/08

[52] U.S. Cl. ..... 173/1; 173/128; 173/147; 173/46; 173/184

[58] Field of Search ..... 173/1, 91, 31, 173/32, 128, 132, 89, 92, 46, 53, 184, 147; 405/231, 232

[56] References Cited

U.S. PATENT DOCUMENTS

| | | | |
|---|---|---|---|
| 1,569,763 | 1/1926 | Litter | 173/128 |
| 3,815,373 | 6/1974 | Giroux | 173/91 |
| 4,473,123 | 9/1984 | Ranft et al. | 173/91 |
| 4,534,419 | 8/1985 | Vural | 173/1 |
| 5,088,564 | 2/1992 | Kobayashi | 173/1 |
| 5,332,047 | 7/1994 | Hignite | 405/232 |
| 5,375,664 | 12/1994 | McDowell et al. | 173/147 |

*Primary Examiner*—Scott A. Smith
*Attorney, Agent, or Firm*—G. F. Gallinger

[57] ABSTRACT

The most dangerous task in mechanically driving a post into the ground is initially holding the post in an upright position while it is hammered to start it into the ground. When used with mobile equipment having an hydraulically driven post pounder the post picker not only eliminates the danger in starting a post into the ground, but additionally eliminates the necessity of using more than one man to do the job! A method is disclosed wherein a single hydraulic valve on a piece of mobile equipment may be used to control both the post picker and pounder. The post picker comprises: a support arm having a base end portion secured to the post pounder and an opposite hinge end portion; a frame hinged to the hinge end portion of the support arm rotatable between a generally horizontal post grasping position and a hanging upright position; a jaw slidably mounted on a central portion of the frame; a hydraulic piston carried by the frame having one end operatively connected to the sliding jaw; and a frame lift mechanism to swing the frame from the hanging upright position to the horizontal grasping position.

11 Claims, 2 Drawing Sheets

POST PICKER

FIELD OF INVENTION

This invention relates to post pounders. More particularly this invention relates to a post picker adapted to be used in conjunction with a hydraulic post pounder attached to a skid steer loader or another piece of mobile equipment.

BACKGROUND OF THE INVENTION

The most dangerous task in mechanically driving a post into the ground is initially holding the post in an upright position while it is hammered to start it into the ground. If the top portion of the post is struck off center, or alternatively, if the post is misaligned with the swing of the hammer—the post will slip and fly laterally out from beneath the hammer. A mechanical driver which pounds continuously and with great force presents a grave danger to the individual initially positioning the post. If a top portion of the post begins to slip laterally, before it can be straightened—it will be struck again. When the misalignment is sufficient the post will laterally fly out from underneath the hammer with great speed, force, and energy—severely striking any thing or person in its path.

Another problem with the existing way of pounding a post from a mobile piece of equipment is that it requires two persons. Someone must coordinate and pay a helper for assistance. Pieces of mobile equipment generally have only one auxiliary hydraulic valve provided for auxiliary attachments. The addition of more valves is usually cumbersome and prohibitively expensive.

OBJECTS AND STATEMENT OF INVENTION

It is an object of this invention to disclose an apparatus which will automatically pick up and position a post in alignment centrally beneath the hammer of a post pounder. It is an object of this invention to eliminate the need for an individual to stand adjacent to a post to position and steady it beneath the hammer. It is yet a further object of this invention to disclose an apparatus which can move to a lateral position, grasp a post laying on the ground, and then swing the post into upright alignment centrally under the hammer of a post pounder—and accomplish this while being operated from a single auxiliary valve on the piece of mobile equipment. It is a final object of this invention to disclose an apparatus which can not only be operated from a single hydraulic valve, but which can be operated from the same hydraulic valve as the post pounder—so that with a small movement of that valve the operator may first move the apparatus to a lateral position; then with additional movement of the valve he may grasp a post lying on the ground; and then, by lifting the post pounder, he may swing the post into alignment beneath the hammer of the post pounder; and finally, with continued movement of the same valve he may increase hydraulic line pressure so that the hammer of the post pounder will cycle pounding the positioned post into the ground.

One aspect of this invention provides for a post picker for use with a post pounder carried by a piece of mobile equipment having an auxiliary hydraulic valve comprising: a support arm having a base end portion secured to the post pounder and an opposite hinge end portion; a frame hinged to the hinge end portion of the support arm rotatable between a generally horizontal post grasping position and a hanging upright position; a jaw slidably mounted on a central portion of the frame; a hydraulic piston carried by the frame having one end operatively connected to the sliding jaw; and a mechanism to swing the frame from the hanging upright position to the horizontal grasping position. In use when the hydraulic valve is partially opened, the frame lift mechanism swings the frame to the horizontal grasping position, and when the hydraulic valve is further opened the sliding jaw moves to a closed position.

Another aspect of this invention provides for a method of picking up, and driving a post into the ground with a post picker and pounder which are carried together by a mobile piece of equipment and controlled by a single auxiliary hydraulic valve on the mobile piece of equipment, comprising the following steps: moving the control valve a minimal amount to swing the post picker into a horizontal grasping position with extended jaws; positioning the post pounder and picker above the post at a spaced distance measured along the post from the top of the post; lowering the post pounder and picker to position the post between the jaws of the post picker; moving the control valve to close the jaws of the picker on the post; raising the post pounder and picker so that the post hangs in an upright position beneath the post pounder; positioning the post to be driven into the ground in the correct location above the ground; lowering the post pounder so that it is seated on the top portion of the post; briefly moving the control valve in a reverse direction to release the jaws on the post; lowering the post pounder so that its floating head is elevated and resting on the post; and then, moving the control valve to a fully open position to operate the post pounder.

Various other objects, advantages and features of novelty which characterize this invention are pointed out with particularity in the claims which form part of this disclosure. For a better understanding of the invention, its operating advantages, and the specific objects attained by its users, reference should be made to the accompanying drawings and description, in which preferred embodiments of the invention are illustrated.

FIGURES OF THE INVENTION

The invention will be better understood and objects other than those set forth will become apparent to those skilled in the art when consideration is given to the following detailed description thereof. Such description makes reference to the annexed drawings wherein:

FIGS. 2A–2F show the method of picking up and driving a post into the ground.

FIG. 2A shows the post pounder and picker lowered onto and engaging a post.

FIG. 2B shows the post pounder and picker being raised so that the post will swing into an upright position.

FIG. 2C shows the post pounder raised so that the post hangs therebelow in an upright position correctly located for driving into the ground.

FIG. 2D shows the post pounder after the jaws of the picker have released the post, and the pounder has been partially lowered so that its floating head is supported on the post.

FIG. 2E shows the post pounder having its hammer in a fully raised position.

FIG. 2F shows the post pounder having its hammer in a fully lowered position, having struck the floating head, and partially driven the post into the ground.

Figure 1:
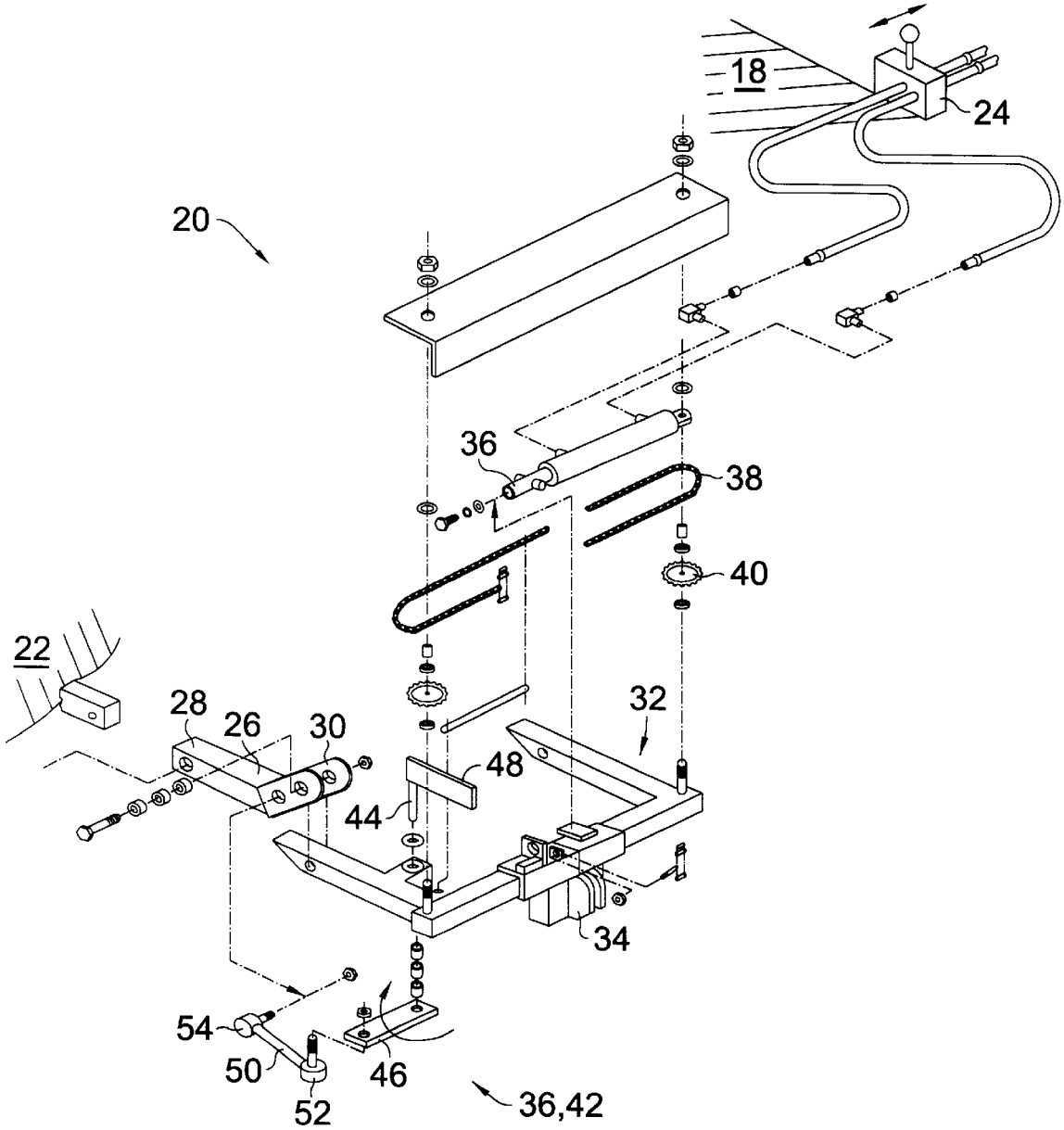
FIG. 1 is an exploded perspective view of a post picker.

The following is a discussion and description of the preferred specific embodiments of this invention, such being made with reference to the drawings, wherein the same reference numerals are used to indicate the same or similar parts and/ or structure. It should be noted that such discussion and description is not meant to unduly limit the scope of the invention.

DESCRIPTION OF THE INVENTION

Turning now to the drawings and more particularly to FIG. 1 we have an exploded perspective view of a post picker 20. The post picker 20 is used with a post pounder 22 carried by a piece of mobile equipment 18. It is controlled by a single auxiliary hydraulic valve 24 located on the mobile equipment 18. The post picker 20 comprises: a support arm 26 having a base end portion 28 secured to the post pounder 22 and an opposite hinge end portion 30; a frame 32 hinged to the hinge end portion of the support arm 26 which is rotatable between a generally horizontal post grasping position (see FIG. 2A) and a hanging upright position (see FIG. 2C); a jaw 34 slidably mounted on a central portion of the frame 32; a hydraulic piston 36 carried by the frame 32 having one end operatively connected to the sliding jaw 34; and frame lift means 36 to swing the frame 32 from the hanging upright position to the horizontal grasping position. In use when the hydraulic valve is partially opened, the frame lift means swings the frame to the horizontal grasping position, and when the hydraulic valve is further opened the sliding jaw moves to a closed position.

Most preferably the frame 32 is supported by two support arms 26, each which extends forward from an opposite side of the post pounder 22. Opposite side portions of the frame 32 are hinged to each of the support arms 26. Most preferably there are two sliding jaws 34 which operatively driven by a continuous loop of chain 38. The chain is mounted on two rotatable sprockets 40 mounted on an opposite end portion of the frame 32. One jaw 34 is moved by one portion of the loop of chain 38, and the other jaw 34 is moved by an opposite portion of the loop of chain 38, so that when the piston 36 extends the sliding jaws 34 move equally together.

In the preferred embodiment of the invention the frame lift means 36 comprises a link mechanism 42. The link mechanism 42 is configured so that when the piston 36 first moves, the frame 32 is swung to the horizontal grasping position, and thereafter further movement of the piston 36 advances the jaws 34 together. Most preferably the link mechanism 42 comprises a rotatable member 44 having a driven piston contact arm 48, a driver arm 46, and a tie rod 50. The tie rod 50 has a floating end 52 fastened to an outer end portion of the driver arm 46 and an opposite secured end portion 54 rotatably fastened to the support arm 26, so that when the piston 36 first extends, the driven piston contact arm 48 is rotated causing the frame 32 to swing to a horizontal grasping position, and then, as the piston 32 extends further, the jaws 34 move together. In the most preferred embodiment of the invention the rotatable member 44 extends perpendicularly through the frame 32, and the driven contact arm 48 is driven by piston 36 which is carried above the frame 32. The driver arm 46 is rotatably fastened to the tie rod 50 beneath the frame 32.

FIGS. 2A–2F are elevational views of the post picker 20 shown in FIG. 1 mounted on a post pounder 22. FIGS. 2A–2F show the method of picking up and driving a post 21 into the ground 19. A method of picking up, and driving a post 21 into the ground 19 with a post picker 20 and post pounder 22 which are carried together by a mobile piece of equipment 18 and controlled by a single auxiliary hydraulic valve 24 on the mobile piece of equipment 18, comprises the following steps.

Figures 2A, 2B, 2C, 2D, 2E, 2F:
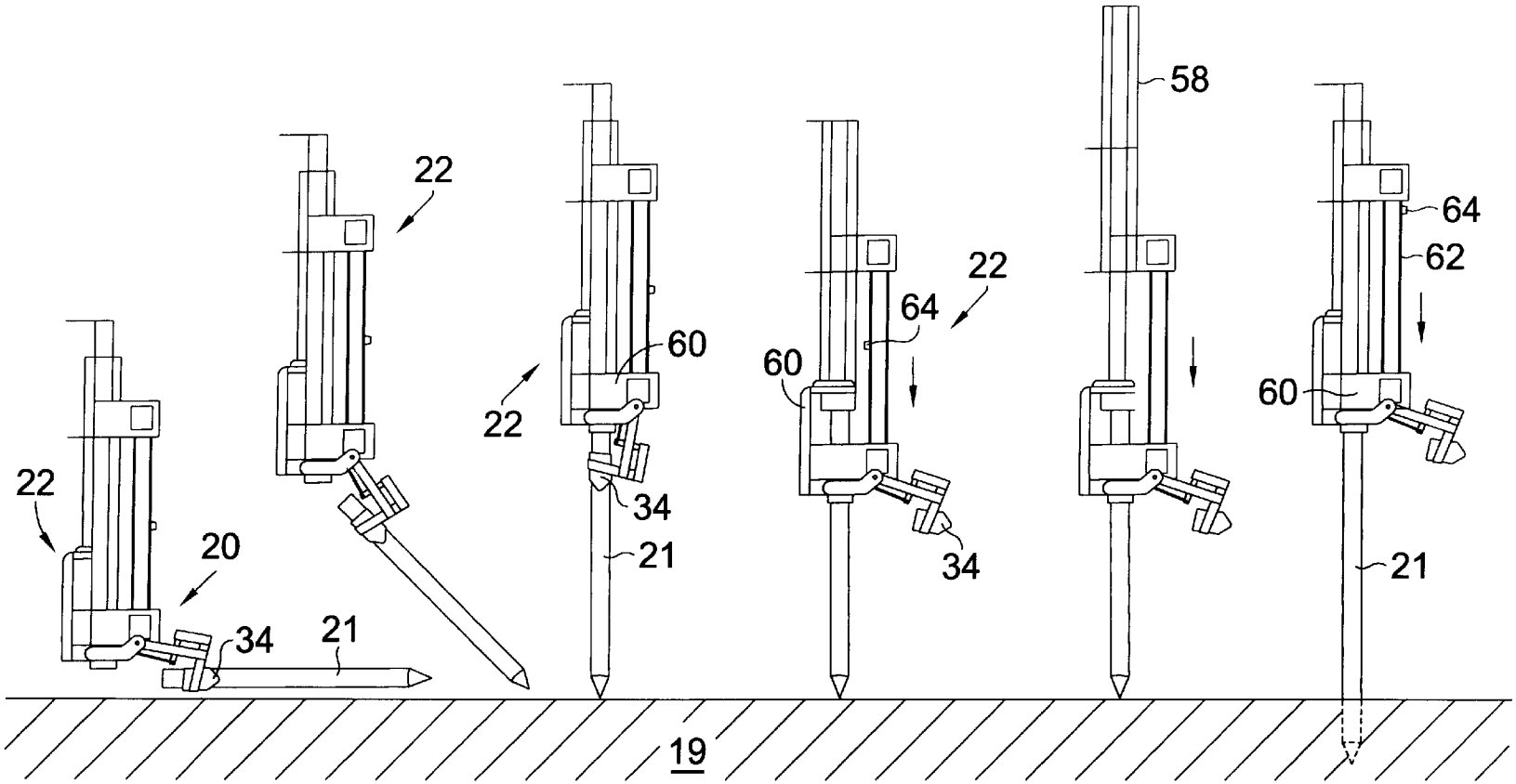
FIGS. 2A–2F are elevational views of the post picker shown in FIG. 1 mounted on a post pounder.

The control valve 24 is moved a minimal amount to swing the post picker 20 into a horizontal post grasping position with extended jaws 34. The post picker 20 are positioned above the post 34 at a spaced distance along the post 34 measured from the top of the post 34 (so that the post 34 will be centered under the hammer 60 and floating head 62 of the post pounder 22). The post pounder 22 and picker 20 are then lowered to position the post 21 between the jaws 34 of the post picker 20. The control valve 24 is then moved just enough to close the jaws 34 of the picker 20 on the post 21. FIG. 2A shows the post pounder 22 and picker 20 lowered onto and engaging a post 21.

The post pounder 22 and picker 20 are next raised so that the post 21 hangs in an upright position beneath the post pounder 22. FIG. 2B shows the post pounder 22 and picker 20 being raised so that the post 21 will swing into an upright position. The post 21 is correctly positioned on the ground 19 so that it may be driven into the ground 19 in the correct location. The post pounder 22 is lowered so that it is seated on the top portion of the post 21. FIG. 2C shows the post pounder 22 raised so that the post 34 hangs therebelow in an upright position correctly located for driving into the ground 19.

Thereafter the control valve 24 is briefly moved in a reverse direction to release the jaws 34 on the post 21; and then, the post pounder 22 is lowered so that its floating head 60 is elevated and resting on the post 21 (see FIG. 2D) so that when the control valve 24 is moved to a fully open position the hammer 58 of the post pounder 22 will be raised (see FIG. 2E), thereafter cyclically dropping the hammer 58 on the floating head 60 thereby pounding the post 21 into the ground 19 (see FIG. 2E).

In the preferred method the post pounder 22 is of the type having a continuous loop of chain 62 having a lifting lug 64 used to lift the hammer 58. When the loop of chain is hydraulically driven the pounder 22 and picker 20 may then be controlled by a single hydraulic valve 24. In the most preferred embodiment of the invention a one way valve (not shown) is utilised to insure that chain 62 may turn in one direction only.

While the invention has been described with preferred specific embodiments thereof, it will be understood that this description is intended to illustrate and not to limit the scope of the invention. The optimal dimensional relationships for all parts of the invention are to include all variations in size, materials, shape, form, function, assembly, and operation, which are deemed readily apparent and obvious to one skilled in the art. All equivalent relationships to those illustrated in the drawings, and described in the specification, are intended to be encompassed in this invention. What is desired to be protected is defined by the following claims.

I claim:

1. A post picker for use with a post pounder carried by a piece of mobile equipment, said mobile equipment having an auxiliary hydraulic valve, comprising:

a support arm having a base end portion secured to the post pounder and an opposite hinge end portion;

a frame hinged to the hinge end portion of the support arm rotatable between a generally horizontal post grasping position and a hanging upright position;

a jaw slidably mounted on a central portion of the frame;

a hydraulic piston carried by the frame having one end operatively connected to the sliding jaw;

and frame lift means to swing the frame from the hanging upright position to the horizontal grasping position;

wherein use when the hydraulic valve is partially opened, the frame lift means swings the frame to the horizontal grasping position, and when the hydraulic valve is further opened the sliding jaw moves to a closed position.

2. A post picker as in claim 1 further comprising a second sliding jaw and a continuous loop of chain, said chain mounted on two sprockets, each rotatably mounted on an opposite end portion of the frame, one jaw moved by one portion of the loop of chain, and the other jaw moved by an opposite portion of the loop of chain, configured so that when the piston extends the sliding jaws move equally together.

3. A post picker as in claim 2 wherein the lift means comprises a link mechanism configured so that when the piston first moves, the frame is swung to the horizontal grasping position, and thereafter further movement of the piston advances the jaws together.

4. A post picker as in claim 3 wherein the linked mechanism comprises a rotatable member having a driven piston contact arm, a driver arm, a tie rod having a floating end fastened to an outer end portion of the driver arm and an opposite secured end portion rotatably fastened to the support arm, so that when the piston first extends, the driven piston contact arm is rotated causing the frame to swing up to a horizontal grasping position, and then, as the piston extends further, the jaws move together.

5. A post picker as in claim 1 wherein there are two support arms, each extending forwardly from an opposite side of the post pounder, and wherein opposite side portions of the frame are hinged to each of the support arms.

6. A post picker as in claim 5 wherein the rotatable member extends perpendicularly through the frame, and wherein the driven contact arm thereof is driven by a piston carried above the frame, and wherein the driver arm thereof is rotatably fastened to the tie rod beneath the frame.

7. A method of picking up, and driving a post into the ground with a post picker and pounder which are carried together by a mobile piece of equipment and controlled by a single auxiliary hydraulic valve on the mobile piece of equipment, comprising the following steps:

moving the control valve a minimal amount to swing the post picker into a horizontal grasping position with extended jaws;

positioning the post pounder and picker above the post at a spaced distance measured along the post from the top of the post;

lowering the post pounder and picker to position the post between the jaws of the post picker;

moving the control valve to close the jaws of the picker on the post;

raising the post pounder and picker so that the post hangs in an upright position beneath the post pounder;

positioning the post to be driven into the ground in the correct location above the ground;

lowering the post pounder so that it is seated on the top portion of the post;

briefly moving the control valve in a reverse direction to release the jaws on the post;

lowering the post pounder so that its floating head is elevated and resting on the post; and then, operationally engaging the post pounder so that the post is pounded into the ground.

8. A method as in claim 7 wherein the post pounder is operationally engaged by moving the control valve to a more fully open position.

9. A method as in claim 8 wherein the post pounder is of the type having a hammer and a floating head, and further comprises the step of lowering the post pounder so that its floating head is elevated and resting on the post; before the step of moving the control valve to a more fully open position to operating the post pounder wherein the hammer cyclically drops on the floating head thereby pounding the post into the ground.

10. A method as in claim 9 wherein the post pounder is of the type having at continuous loop of chain having a lifting lug used to lift the hammer so that it will pound continuously when the loop of chain is driven.

11. A method as in claim 10 wherein post pounder is hydraulically driven.

* * * * *